US005133535A

United States Patent [19]

Soofi

[11] Patent Number: 5,133,535

[45] Date of Patent: Jul. 28, 1992

[54] IMPACT PAD WITH HORIZONTAL FLOW GUIDES

[75] Inventor: Madjid Soofi, St. Charles, Ill.

[73] Assignee: Magneco/Metrel, Inc., Addison, Ill.

[21] Appl. No.: 768,024

[22] Filed: Sep. 30, 1991

Related U.S. Application Data

[63] Continuation-in-part of Ser. No. 726,868, Jul. 8, 1991, which is a continuation of Ser. No. 530,164, May 29, 1990, Pat. No. 4,072,916.

[51] Int. Cl.[5] ..... C21B 7/14

[52] U.S. Cl. ..... 266/275; 266/229; 222/594

[58] Field of Search ..... 266/275, 236, 238, 229, 266/230, 231, 287; 222/594; 164/337, 437, 362, 281; 249/206

[56] References Cited

U.S. PATENT DOCUMENTS

| | | | |
|---|---|---|---|
| 1,727,565 | 9/1929 | Schall | 164/362 |
| 2,301,880 | 11/1942 | Johnston, Jr. | 266/278 |
| 2,406,380 | 8/1946 | Johnston, Jr. | 266/278 |
| 3,814,167 | 6/1974 | Listhuber et al. | 164/281 |
| 3,887,171 | 6/1975 | Neuhaus | 266/34 |
| 4,033,546 | 7/1977 | Guegan | 249/174 |
| 4,042,229 | 8/1977 | Eccleston | 266/275 |
| 4,177,855 | 12/1979 | Duchateau et al. | 164/82 |
| 4,209,162 | 6/1980 | Petiau | 249/206 |
| 4,711,429 | 12/1987 | Diederich et al. | 164/337 |
| 4,715,586 | 12/1987 | Schmidt et al. | 266/275 |
| 4,756,749 | 7/1988 | Praitoni et al. | 266/236 |

FOREIGN PATENT DOCUMENTS

| | | | |
|---|---|---|---|
| 2643009 | 3/1978 | Fed. Rep. of Germany . | |
| 1081253 | 6/1954 | France . | |
| 0065887 | 11/1955 | France . | |
| 2132517 | 11/1972 | France . | |
| 2278428 | 7/1974 | France . | |
| 2314789 | 1/1977 | France . | |
| 8008534 | 3/1978 | Japan . | |
| 63-2539 | 1/1988 | Japan . | |
| 0174764 | 7/1988 | Japan | 164/437 |

*Primary Examiner*—Scott Kastler

*Attorney, Agent, or Firm*—Willian Brinks Olds Hofer Gilson & Lione

[57] ABSTRACT

An impact pad for use in a tundish vessel utilizes outer and inner guides which partially surround the region of impact except in the direction of the one or more tundish drains. Much of the molten iron or steel entering the tundish is directed toward a drain by the inner guide or guides. The inner and outer guides define a channel such that molten iron or steel which splashes or otherwise flows over the inner guides can also be directed toward the one or more tundish drains.

20 Claims, 4 Drawing Sheets

IMPACT PAD WITH HORIZONTAL FLOW GUIDES

RELATED APPLICATIONS

This application is a continuation-in-part of Ser. No. 07/726,868, filed on July 8, 1991, the entire disclosure of which is incorporated herein by reference. Ser. No. 07/726,868 is a continuation of Ser. No. 07/530,164, filed on May 29, 1990, now U.S. Pat. No. 5,072,916, the entire disclosure of which is incorporated herein by reference.

FIELD OF THE INVENTION

This invention relates to an impact pad used in a tundish vessel to reduce turbulence and direct the flow of molten iron and steel within the vessel.

BACKGROUND OF THE INVENTION

In a tundish vessel of the type used in the iron and steel industry, there are typically variations in the purity of the molten iron or steel contained therein. When the motel iron and steel is in a nonagitated, nonturbulent state, impurities in the molten material tend to float to the top of the motel material, causing formation of a so-called "slag" layer. In other words, the purest of the molten iron or steel exists near the bottom of the vessel.

Molten iron or steel is poured into the tundish vessel from the top, and exits at the bottom. By maintaining a sufficient level of molten iron or steel in the vessel, and a sufficient residence time to allow impurities to float to the top, the concentration of impurities is reduced to a minimum in the lowermost portion of the vessel where the molten material leaves the vessel for further processing. Problems associated with impurities occur, however, when the pouring of molten iron or steel into the tundish from the top creates sufficient agitation and turbulence that some of the slag material is forced downward into the lowermost portion of the tundish vessel, or is prevented from rising. Turbulence also occurs due to uneven and other undesirable flow patterns near the bottom of the vessel.

Various methods and devices have been in. vented for the purpose of reducing turbulence in a tundish vessel caused by the pouring of molten iron or steel into the vessel. In U.S. Pat. No. 4,177,855, a pair of swinging doors is shown in which helps protect the slag layer from turbulence caused by the pouring of molten metal. A flat impact pad provides an elevated splashing surface which helps contain most of the turbulence between the swinging doors.

U.S. Pat. No. 4,042,229 discloses an impact pad having a pair of sidewalls for inhibiting the flow of the molten iron or steel to the sidewalls of the tundish vessel. A second pair of sidewalls positioned far above the impact pad, helps separate the pouring region from the slag layer.

German patent 2,643,009 discloses a splash plate which includes a plurality of interlocking protrusions arranged in a honeycomb configuration.

Some of the prior art devices have reduced the horizontal flow of the molten material to the sides of the vessel using various sidewalls which help direct the flow toward the drains located at one or both ends of the vessel. However, significant flow of molten material toward the sides of the tundish level still results from molten material flowing over the sidewalls of the prior art impact pads. This overflowing contributes to uneven and undesirable flow patterns and turbulence within the tundish vessel and also contributes to stagnation, i.e. regions wherein the molten steel is separated from the main stream and experiences very little flow.

SUMMARY OF THE INVENTION

The present invention is directed to an impact pad for use in a tundish vessel which includes an outer guide and an inner guide defining a channel therebetween, on both lateral sides of the impact pad which are nearest to the side walls of the tundish vessel. The impact pad is positioned in the region of impact of the tundish vessel such that the molten steel is poured onto the impact pad within an area defined by the inner guide or guides.

As is common with the prior art devices, some of the molten steel will flow over the top of the inner guide or guides. However, in accordance with the invention, molten steel which passes over an inner guide is further inhibited by the corresponding outer guide, from flowing toward a sidewall of the tundish. Much of the steel which passes over the inner guide flows into the channel between the inner and outer guides. The channel then redirects the flow of the steel toward the main flow stream leading to the drain or drains which can be located at one or both ends of the tundish vessel. The effects of the invention are to minimize crosscurrents and other undesirable flow patterns and turbulence, and also to reduce stagnation.

With the foregoing in mind, it is a feature and advantage of the invention to provide an improved impact pad which reduces horizontal flow of molten steel from the region of impact toward the sides of the tundish vessel.

It is also a feature and advantage of the invention to provide an impact pad which channels the molten steel from the region of impact toward the main flow stream leading to the drain or drains in a tundish vessel.

It is also a feature and advantage of the invention to provide a tundish vessel having smoother flow and reduced turbulence between the region of impact and the drain or drains.

It is also a feature and advantage of the invention to provide an impact pad and tundish vessel which reduce stagnation between the region of impact and the sidewalls of the tundish.

By reducing turbulence and stagnation, it is also a feature and advantage of the invention to provide an impact pad and tundish vessel which cause the molten steel exiting the tundish to have improved quality and purity.

The foregoing and other features and advantages of the invention will become further apparent from the following detailed description of the presently preferred embodiments, made with reference to the accompanying figures. This detailed description is intended to be illustrative rather than limitative, the scope of the invention being defined by the appended claims and equivalents thereof.

DETAILED DESCRIPTION OF THE PRESENTLY PREFERRED EMBODIMENTS

Figure 1:
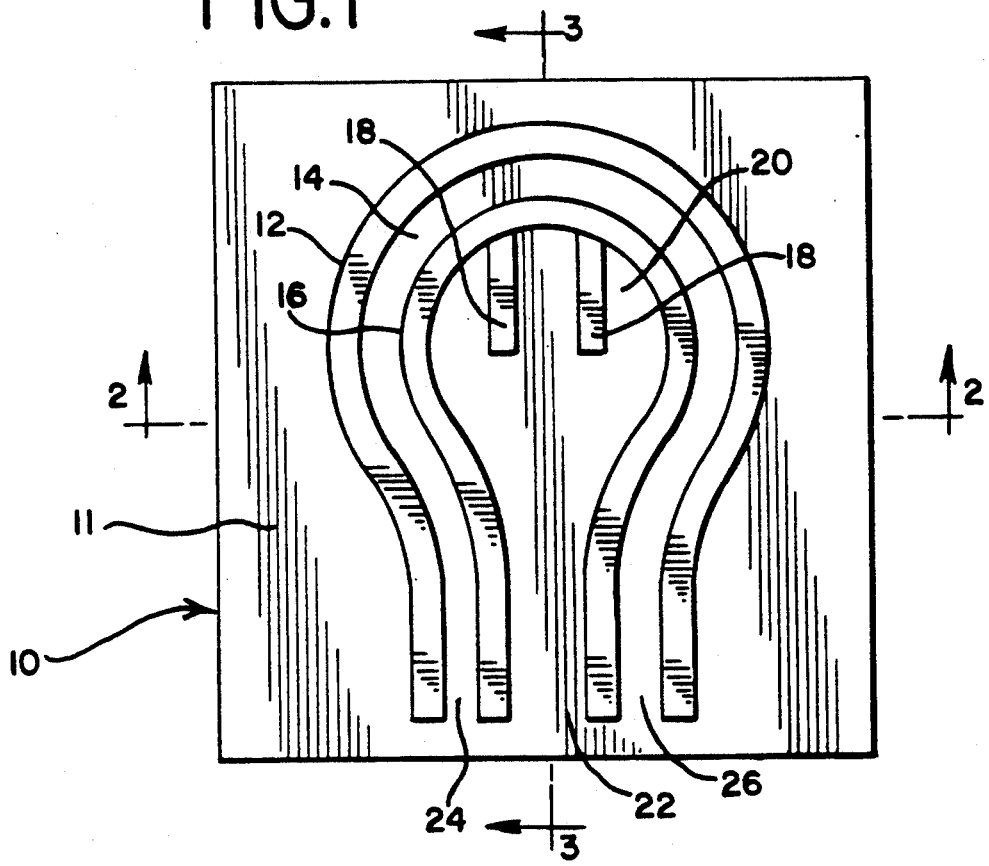
FIG. 1 shows a top plan view of a tundish impact pad of the invention, designed for use in a tundish vessel having a drain at only one end.
Figure 2:
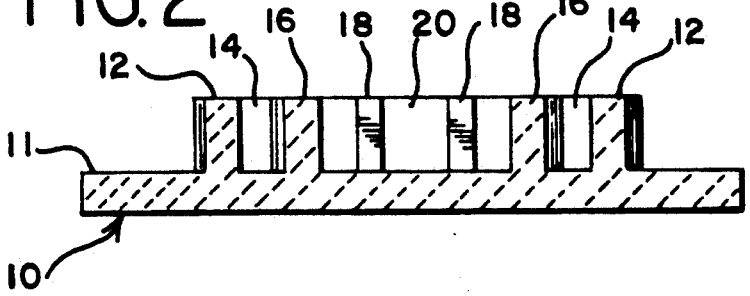
FIG. 2 is a sectional view of the impact pad of FIG. 1, taken along the line 2—2.
Figure 3:
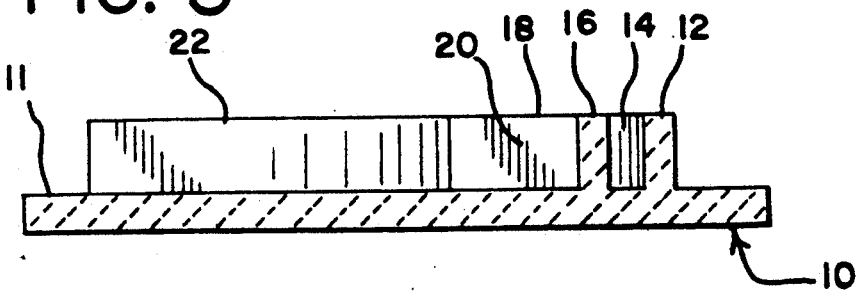
FIG. 3 is a sectional view of the impact pad of FIG. 1, taken along the line 3—3.

Referring first to FIGS. 1-3, a tundish impact pad 10 of the invention is shown having a base 11. Projecting upward from the base 11 are an outer guide 12 and an inner guide 16 which define a channel 14 therebetween. The channel 14 is open at both ends 24 and 26 and is preferably free of any flow obstructions except for the guides 12 and 16 which define the channel 14. The advantage of providing a channel 14 free of flow obstructions is to ensure a smooth, continuous flow of molten steel within the channel toward the ends 24 and 26.

The inner guide 16 is configured such as to surround the impact region 20 on all sides except the side which faces the drain when the impact pad 10 is positioned in a tundish vessel. The inner guide 16 defines a channel having an outlet 22 in the direction of the drain, through which molten steel can easily flow from the impact region 20. The impact region 20 is the portion of the impact pad which is positioned directly beneath the molten steel as it is being poured into the tundish vessel, i.e., the portion which experiences the first contact with the molten steel.

The outer guide 12 is configured such as to surround the inner guide on all sides except the side which faces the drain. The openings 24 and 26 of the channel 14 defined by the outer and inner guides point in the direction of the drain, and are on both sides of the opening 22.

The guides 12 and 16 preferably have a partially semi-circular configuration, wherein the only deviation from the semi-circular pattern allows formation of the openings 22, 24 and 26 which face the drain in a tundish vessel. The impact pad 10 should be positioned in a tundish vessel such that the greatest impact occurs at the center of the semicircles. Preferably, the guides 12 and 16 are configured such that their semicircular portions are concentric.

The impact region 20 (i.e. the portion of the impact pad 10 which is inside the circle defined in part by the inner guide 16) may be flat or may be designed in any pattern which facilitates the reduction of turbulence. In the embodiment shown in FIGS. 1-3, two impact guides 18 are shown which help to further contain the turbulence and reduce the flow toward the sidewalls of the tundish. The impact guides 18 project upward from the base 11. The impact guides 18 are straight and parallel to each other and to the sidewalls of the tundish. Each impact guide 18 abuts the inner guide 16 at one end. Other configurations of the impact region 20 may also be utilized including, for example, the sinusoidal and other wave patterns disclosed in the parent applications U.S. Ser. Nos. 07/226,868 and 07/530,164, the entire disclosures of which are incorporated herein by reference.

In the embodiment shown in FIGS. 1-3, the outer guide 12, inner guide 16 and impact guides 18 all project upward from the base portion 11 at about the same height. Alternatively the guides may have different heights, an example being an embodiment wherein the outer guide projects upward at a greater distance than the inner guide. The heights of the guides are limited by the problem of excessive turbulence in the vertical direction which results if the guides are too tall. In other words, the heights of the guides should be selected so that the guides minimize turbulence in the horizontal direction without causing excessive vertical turbulence. The optimum guide heights will vary de pending on the amount and velocity of molten steel entering the tundish, the size and shape of the tundish vessel, and other factors. In the embodiment shown in FIGS. 1-3, the outer, inner, and impact guides are all about six inches in height.

Figure 7:
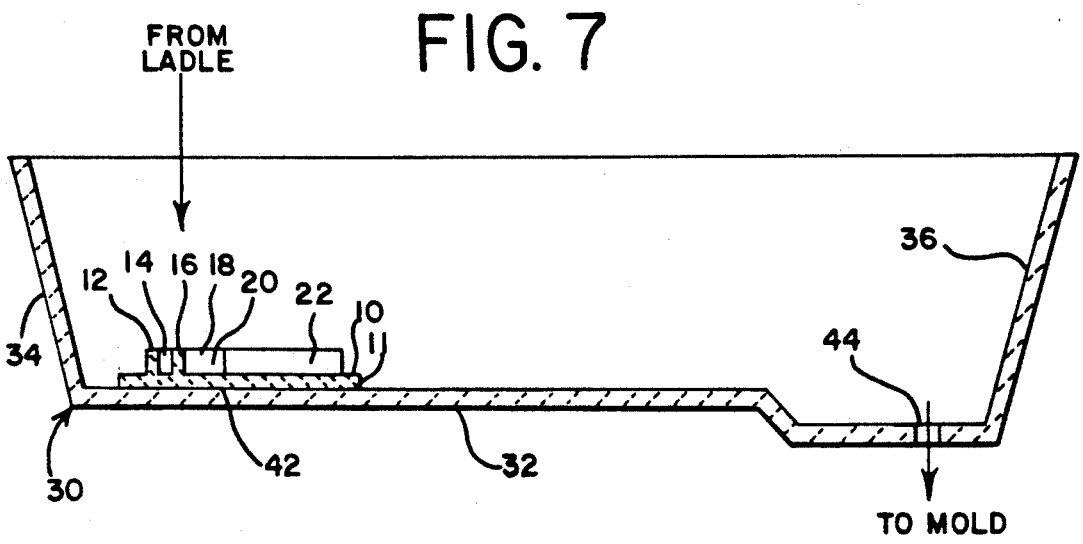
FIG. 7 shows a side sectional view of a tundish vessel including an impact pad of the type shown in FIGS. 1-3.
Figure 8:
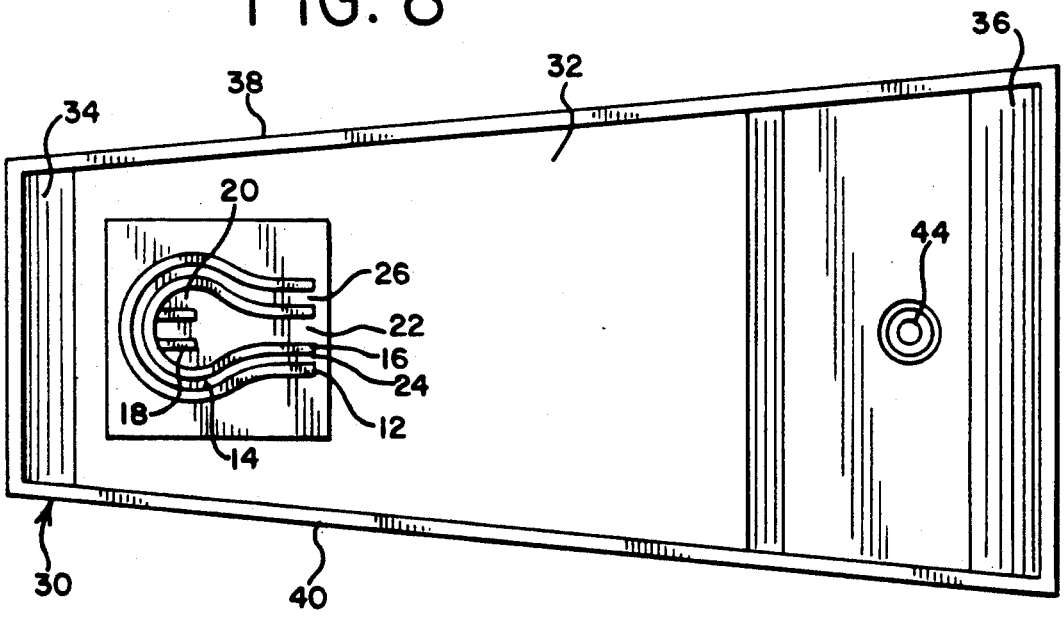
FIG. 8 is a top plan view of the tundish vessel of FIG. 7.

FIGS. 7 and 8 illustrate the positioning and operation of the impact pad 10 in a tundish vessel. The tundish vessel, generally designated as 30, includes a floor 32, a back wall 34, a front wall 36, and two sidewalls 38 and 40. The floor 32 includes a region of impact 42 near the back wall and below where molten steel enters the tundish, and a drain 44 near the front wall where the purified molten steel leaves the tundish.

The impact pad 10 is positioned on the floor 32 of the tundish such that the impact region 20 of the impact pad is above and substantially coincides with the impact region 42 of the tundish vessel. Molten steel is poured into the region of impact 20 from above. While the impact guides 18 help reduce the turbulence, the entering molten steel ultimately fills the impact region 20 on a continuous basis.

Most of the entering molten steel is contained within the inner guide 16 and is channelled through the outlet 22 which points in the direction of the drain 44. However, some of the molten steel splashes or otherwise flows over the top of the inner guide 16 and into the channel 14.

The steel which flows into the channel 14 is substantially contained between the inner guide 16 and the outer guide 12 and is channelled through the open ends 24 of the channel 14. The open ends 24 and 26 of the channel 14 also point toward the drain 44, and are adjacent to the main outlet 22. The result is that most of the molten steel which enters the tundish vessel 30 is channelled and caused to flow in a single direction toward the drain. The inner guide 16 and outer guide 12 act together to prevent most of the steel from flowing toward the back wall 34, or toward the side walls 38 and 40, thereby reducing the overall turbulence with the tundish and reducing the amount of steel which stagnates either behind the region of impact 42 or to the sides.

Figure 4:
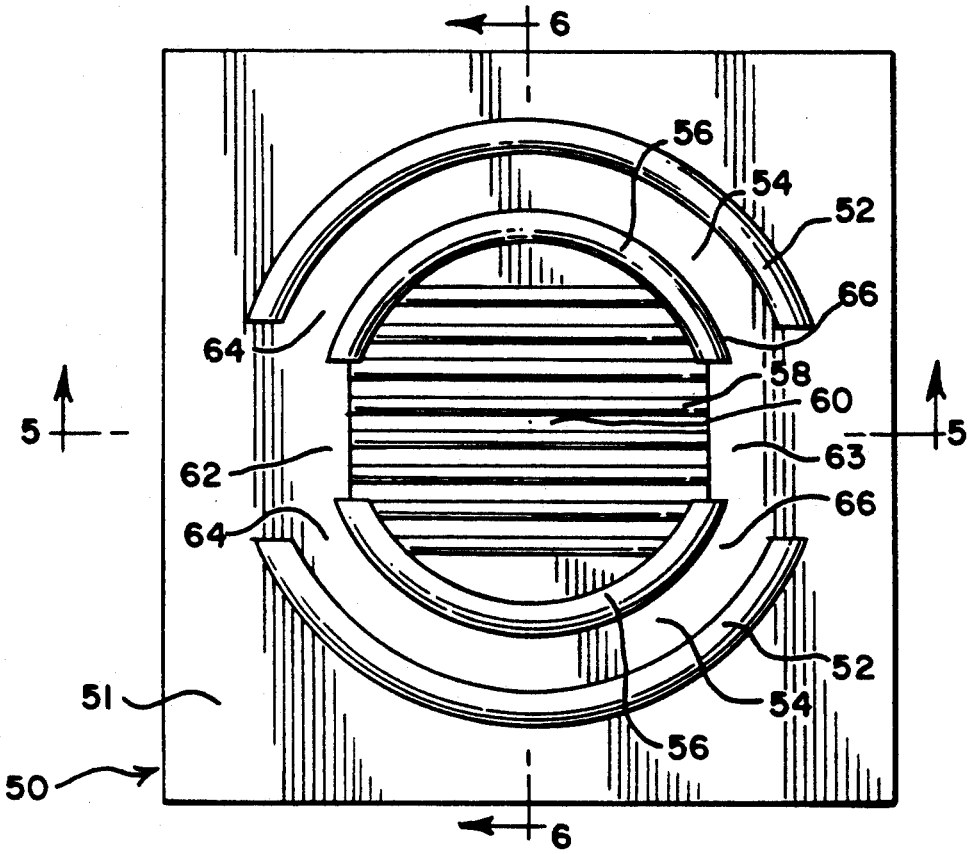
FIG. 4 shows a top plan view of a second embodiment of a tundish impact pad of the invention, designed for use in a tundish vessel having drains at both ends.
Figure 5:
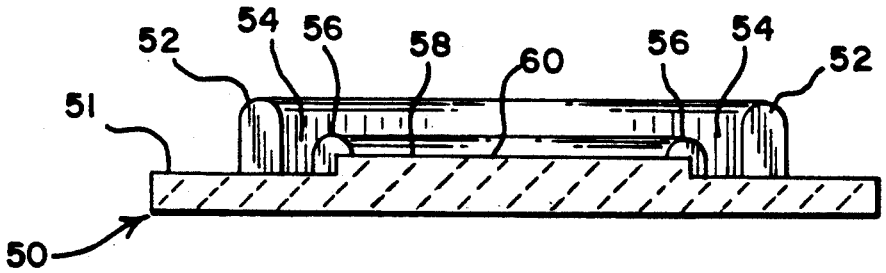
FIG. 5 is a sectional view of the tundish impact pad of FIG. 4, taken along line 5—5.
Figure 6:
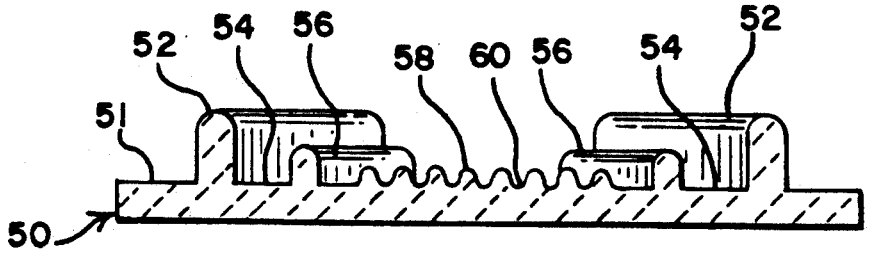
FIG. 6 is a sectional view of the tundish impact pad of FIG. 4, taken along line 6—6.

FIGS. 4-6 illustrate a second embodiment of the impact pad of the invention, generally designated as 50, which is designed for use in generally larger tundish vessels having a region of impact at or near the center of the vessel and drains at both ends. Projecting upward from a base 51 are a pair of outer guides 52 and a pair of inner guides 56, defining a pair of channels 54 therebetween. Each channel 54 is open at both ends 64 and 66 as shown, and is free of any flow obstructions except for the guides 52 and 56 which define each channel 54. The purpose of providing channels 54 free of flow obstructions is to ensure a smooth, continuous flow of molten steel within the channels toward the ends 64 and 66.

The guides 52 and 56 are configured such as to separate the impact region 60 from the sidewalls of a tundish vessel, leaving openings only in the direction of the drains when the impact pad 50 is positioned in a tundish vessel. The inner guides 56 are separated such as to define a channel having outlets 62 and 63 in the direction of each drain, through which molten steel can easily flow from the impact region 60. The guides 52 and 56 preferably have a semi-circular configuration. Preferably, both inner guides 56 define parts of a first circle, both outer guides 52 define parts of a larger second circle, and the first and second circles are concentric.

The impact region 60 (i.e. the portion of the impact pad 50 which is inside the circle defined in part by the inner guides 16) may be flat or may be designed in any pattern which facilitates the reduction of turbulence. In the embodiment shown in FIGS. 1–3, the base 51 in the impact region 60 is characterized by sinusoidal wave pattern 58 such as is described in the parent applications U.S. Serial Nos. 07/726,868 and 07/530,164, the entire disclosures of which are incorporated herein by reference. Other wave patterns, and other patterns, may also be utilized.

In the embodiment shown in FIGS. 4–6, the outer and inner guides, and the sinusoidal wave pattern, have different heights. The outer guides 52 project upward from the base 51 to a greater extent than the inner guides 56. The inner guides 56 project upward to a greater extent than the sine waves of the wave pattern 58. The heights of the outer and inner guides and wave pattern may be different or may be the same, depending on the specific application. Generally, the heights of the guides should be selected such that the guides minimize turbulence in the horizontal direction without causing excessive vertical turbulence. The optimum guide heights will vary depending on the amount and velocity of molten steel entering the tundish vessel, the size and shape of the tundish, and other factors. In the embodiment shown in FIGS. 4–6, the height of the outer guides 52 is about four inches. The height of the inner guides 56 is about two inches. The height of the sine waves defining the wave pattern 58 is about one inches.

Figure 9:
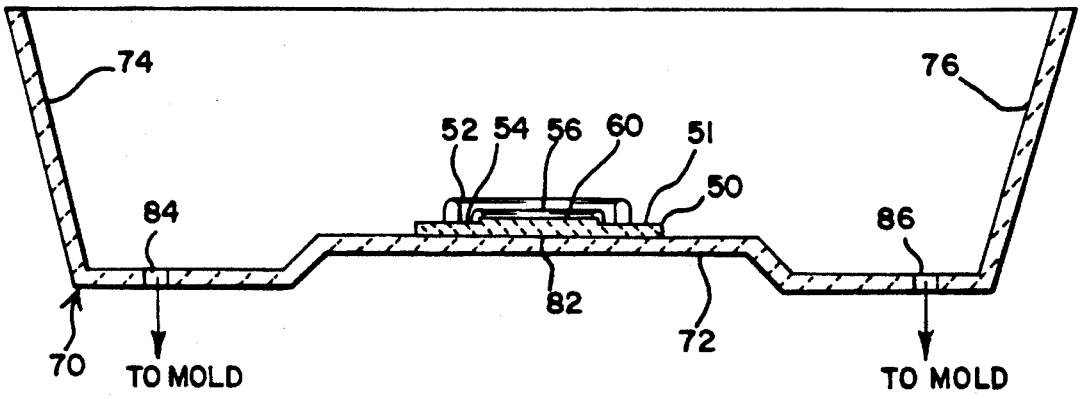
FIG. 9 shows a side sectional view of a tundish vessel including an impact pad of the type shown in FIGS. 4-6.
Figure 10:
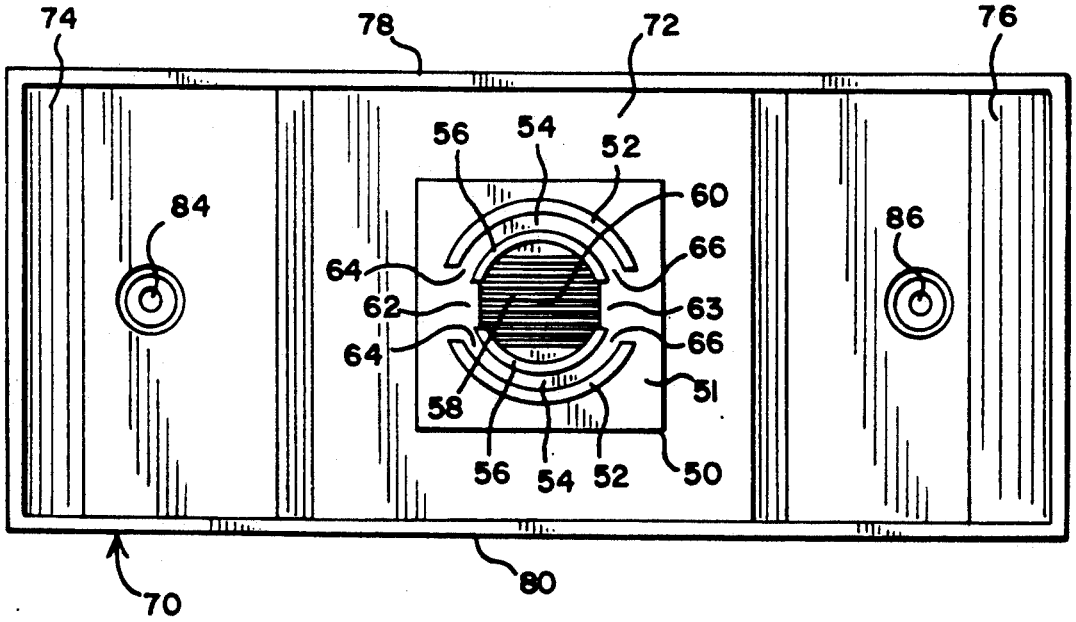
FIG. 10 is a top plan view of the tundish vessel of FIG. 9.

FIGS. 9 and 10 illustrate the positioning and operation of the impact pad 50 in a tundish vessel. The tundish vessel, generally designated as 70, includes a floor 72, two end walls 74 and 76, and two sidewalls 78 and 80. The floor 72 includes a region of impact 82 which is approximately centrally located, and two drains 84 and 86 which are located, respectively, near the end walls 74 and 76.

The impact pad 50 is positioned on the floor 72 of the tundish such that the impact region 60 of the impact pad is above and substantially coincides with the impact region 82 of the tundish vessel. Molten steel is poured into the region of impact 60 from above, and ultimately fills the impact region 60 on a continuous basis. Most of the molten steel is contained within the inner guides 56 and is channelled through the outlets 62 and 63 which point toward the drains 84 and 86, respectively. The sinusoidal wave pattern 58 reduces turbulence in the impact region 60 and reduces vertical splashing. Nevertheless, some of the molten steel splashes or otherwise flows over the inner guides 56 and into the channels 54.

The steel which flows into the channels 54 is substantially contained between the inner guides 56 and the outer guides 52 and is channelled through the open ends 64 and 66 of the channels 54. The open ends 64 of the channels 54 point toward the stream emanating from the one of the main outlets 62, which flows toward the drain 84. The open ends 66 of the channels 54 point toward the stream emanating from the other of the main outlets 63, which flows toward the drain 86. As a result, most of the molten steel which enters the tundish vessel 70 is channelled and caused to flow toward the drains. The inner guides 56 and outer guides 52 act together to prevent most of the steel from flowing toward the sidewalls 78 and 80, thereby reducing the overall turbulence within the tundish and reducing the amount of steel which stagnates near the sidewalls in the vicinity of the impact region 82 of the tundish 70.

The impact pad of the invention is constructed from a high temperature-resistant refractory composition which is capable of withstanding continuous exposure to molten iron or steel at temperatures of up to 3000 degrees Fahrenheit. Preferably, the impact pad is constructed from a refractory material containing 60–85 weight per cent $Al_2O_3$, 38–13 weight per cent $SiO_2$, 0.9–0.5 weight per cent CaO, and 1–0.5 weight per cent $Fe_2O_3$. Other suitable refractory materials including MgO, SiC, $Cr_2O_3$ and $ZrO_2$ may also be utilized. The composition of the impact pad is not limited to the named materials. Any refractory material can be used, so long as the impact pad will be able to withstand continuous, long term exposure to molten iron or steel.

While the embodiments disclosed herein are presently considered to be preferred, it is understood that various modifications and improvements can be made without departing from the spirit and scope of the invention. For example, the impact pad may form part of the integral structure of the tundish vessel. The scope of the invention is indicated in the appended claims, and all changes that are within the meaning and range of equivalency are intended to be embraced therein.

I claim:

1. An impact pad for use in a tundish vessel, comprising:

a base;

a region of impact on the base for receiving molten iron or steel being poured into the tundish vessel;

an inner guide on the base defining a channel for directing flow of molten iron or steel from the region of impact toward the drain in the tundish vessel, at least a portion of the inner guide being a cured wall portion located adjacent to the region of impact and partially surrounding the region of impact; and an outer guide on the base spaced apart from the inner guide, at least a portion of the outer guide being a cured wall portion which at least partially surrounds the curved wall portion of the inner guide;

the inner and outer guides defining a second channel therebetween that receives molten iron or steel which flows over the inner guide from the region of impact and direct the flow of molten iron or steel toward the drain.

2. The impact pad of claim 1 wherein the inner guide defines a channel having an opening in only one direction for directing flow of molten iron or steel from the region of impact toward a drain in a tundish vessel, and surrounds the region of impact in all other directions such as to inhibit the flow of molten iron or steel toward side or back walls of the tundish vessel.

3. The impact pad of claim 2 wherein the outer guide surrounds the inner guide in all directions except toward the drain, the channel defined by the inner and outer guides having openings in the direction of the drain in the vicinity of the opening defined by the inner guide.

4. The impact pad of claim 1 wherein the portion of the inner guide partially surrounding the region of impact is semi-circular.

5. The impact pad of claim 3 wherein the portion of the outer guide partially surrounding the inner guide is semi-circular.

6. The impact pad of claim 1 comprising two inner guides on the base defining a channel therebetween having openings in two directions for directing the flow of molten iron or steel from the region of impact toward two or more drains in a tundish vessel, and surrounding the region of impact in other directions such as to inhibit the flow of molten iron or steel toward sidewalls of the tundish vessel.

7. The impact pad of claim 6 comprising two outer guides on the base spaced apart from each of the respective inner guides, the respective inner and outer guides defining channels therebetween that receive molten iron or steel which flows over the respective inner guides from the region of impact and direct the flow of molten iron or steel toward drains, the outer guides further inhibiting the flow of molten iron or steel toward the sidewalls of the tundish vessel.

8. The impact pad of claim 7 wherein the inner and outer guides have semi-circular configurations, both inner guides define parts of a first circle, and both outer guides define parts of a second circle which is concentric with the first circle.

9. The impact pad of claim 1 further comprising two straight, mutually parallel impact guides on the base in the region of impact, each impact guide having an end which abuts the inner guide.

10. The impact pad of claim 1 further comprising a sinusoidal wave pattern on the base in the region of impact.

11. In a tundish vessel which includes a floor, a back wall, a front wall, two sidewalls, a region of impact located on the floor near the back wall and a drain located on the floor near the front wall, the improvement comprising an impact pad located on the floor covering the region of impact, the impact pad comprising:

a region of impact substantially coincident with the region of impact of the tundish vessel;

an inner guide including a curbed wall portion which surrounds the region of impact in all direction except in the direction of the drain, the inner guide defining a channel from the region of impact which opens in the direction of the drain;

an outer guide including a curved wall portion which surrounds the inner guide in all directions except in the direction of the drain; and a second channel between the inner and outer guides which opens in the direction of the drain.

12. The tundish vessel of claim 11 wherein the inner and outer guides are at least partially semi-circular.

13. The tundish vessel of claim 11 wherein the inner and outer guides have approximately the same height.

14. The tundish vessel of claim 11 further comprising one or more impact guides in the region of impact of the impact pad.

15. The tundish vessel of claim 1 wherein the impact pad forms part of the integral structure of the tundish vessel.

16. In a tundish vessel which includes a floor, a back wall, a front wall, two sidewalls, a region of impact located on the floor approximately centrally between the back and front walls, a first drain located on the floor near the back wall and a second drain located on the floor near the front wall, the improvement comprising an impact pad located on the floor covering the region of impact, the impact pad comprising:

a region of impact substantially coincident with the region of impact of the tundish vessel;

a pair of concave curved inner guides between the region of impact and the sidewalls, the inner guides defining an inner channel with openings in the directions of both the first and second drains;

a pair of concave curved outer guides each of which is between a respective inner guide and a sidewall; and a pair of outer channels each of which is defined by an inner guide and an outer guide, each of which opens in the vicinity of both openings in the inner channel defined by the pair of inner guides.

17. The tundish vessel of claim 16 wherein the inner and outer guides are semi-circular.

18. The tundish vessel of claim 16 wherein the outer guides are taller than the inner guides.

19. The tundish vessel of claim 16 further comprising a sinusoidal wave pattern in the region of impact of the impact pad.

20. The tundish vessel of claim 16 wherein the impact pad forms part of the integral structure of the tundish vessel.

* * * * *